US005565660A

United States Patent [19]

Karner

[11] Patent Number: 5,565,660

[45] Date of Patent: Oct. 15, 1996

[54] APPARATUS IN THE OVERSPEED GOVERNOR OF AN ELEVATOR

[75] Inventor: Franz J. Karner, Jessnitz, Australia

[73] Assignee: Kone Oy, Helsinki, Finland

[21] Appl. No.: 368,656

[22] Filed: Jan. 4, 1995

[30] Foreign Application Priority Data

Jan. 5, 1994 [FI] Finland ..... 940055

[51] Int. Cl.[6] ..... B66B 5/02

[52] U.S. Cl. ..... 187/287; 187/276; 187/289; 187/373

[58] Field of Search ..... 187/373, 374, 187/276, 287, 288, 289

[56] References Cited

U.S. PATENT DOCUMENTS

| | | | |
|---|---|---|---|
| 1,873,809 | 8/1932 | Baldwin | 187/287 |
| 4,531,617 | 7/1985 | Martin et al. | 187/373 |
| 4,653,612 | 3/1987 | Winkler . | |
| 4,662,481 | 5/1987 | Morris et al. | 187/373 |
| 5,278,484 | 1/1994 | Hakala | 187/287 X |

*Primary Examiner*—William E. Terrell
*Assistant Examiner*—Dean A. Reichard

[57] ABSTRACT

The overspeed governor is provided with a switch to disable the operation of the elevator motor. The apparatus includes a controllable actuator which resets the switch into a state enabling the operation of the elevator motor. The actuator is preferably a geared d.c. motor.

12 Claims, 3 Drawing Sheets

APPARATUS IN THE OVERSPEED GOVERNOR OF AN ELEVATOR

FIELD OF THE INVENTION

The present invention relates to an apparatus in the overspeed governor of an elevator.

BACKGROUND OF THE INVENTION

Conventionally, elevators are provided with a safety gear which is triggered by an overspeed governor. In a common solution, when the elevator speed reaches a limit value preset in the overspeed governor, the overspeed governor triggers the safety gear by means of the same rope which transmits the elevator motion to the overspeed governor. The structure and operation of an overspeed governor of this type is described in U.S. patent specification No. 4,653,612. The overspeed governor is provided with a switch for switching off the supply of operating power to the elevator motor at a speed slightly below the gripping speed of the elevator. In addition to overspeed situations, there are situations in which it should be possible to activate the safety gear of the elevator even if the elevator speed does not exceed the allowed limit. These situations include the testing of the safety gear in connection with the inspection of the elevator. Another situation of this type could be the case where an elevator has to be stopped by means of the safety gear after it has left a floor with the doors completely or partially open.

In the situations referred to, the elevator cannot be restarted before the switch controlling the supply of operating power has been reset. A further problem at present is that the overspeed governor has to be so placed that it and the switch placed in conjunction with it can be accessed during inspection and in other situations if necessary. If elevator has a machine room, the problem is a minor one, but in other solutions relating to the placement of the machinery, when the overspeed governor is placed in the elevator shaft, a separate inspection door is needed to provide access the overspeed governor and the switch.

SUMMARY OF THE INVENTION

To meet the above-described need to reset the switch controlling the supply of operating power to the elevator and to solve the problems referred to, an apparatus in the overspeed governor of an elevator is presented as an invention.

The advantages provided by the invention include the following:

- The invention enables the switch placed in conjunction with the overspeed governor to be reset without requiring much work, making it easy to test the operation of the elevator.
- The invention can be used in situations in which the elevator has been stopped by the action of the overspeed governor, to restart the elevator. This applies to cases when the elevator has left a floor with the doors open.
- The solution implementing the invention is simple and requires no changes in the basic structure of the overspeed governor.
- The solution of the invention tolerates normal variations in dimensioning occurring in manufacture and does not require any extraordinary accuracy in installation or maintenance.

- An overspeed governor containing the invention can be both triggered and reset by remote control and it can therefore be installed e.g. on the ceiling or bottom of the elevator shaft, without requiring a separate inspection door.
- The invention is also applicable for use in bidirectional overspeed governors.

In the following, the invention is described in detail by the aid of a few examples, which in themselves do not constitute a limitation of the invention. In the examples, the application of the invention is described in connection with an overspeed governor like the one described in U.S. patent specification No. 4,653,612.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
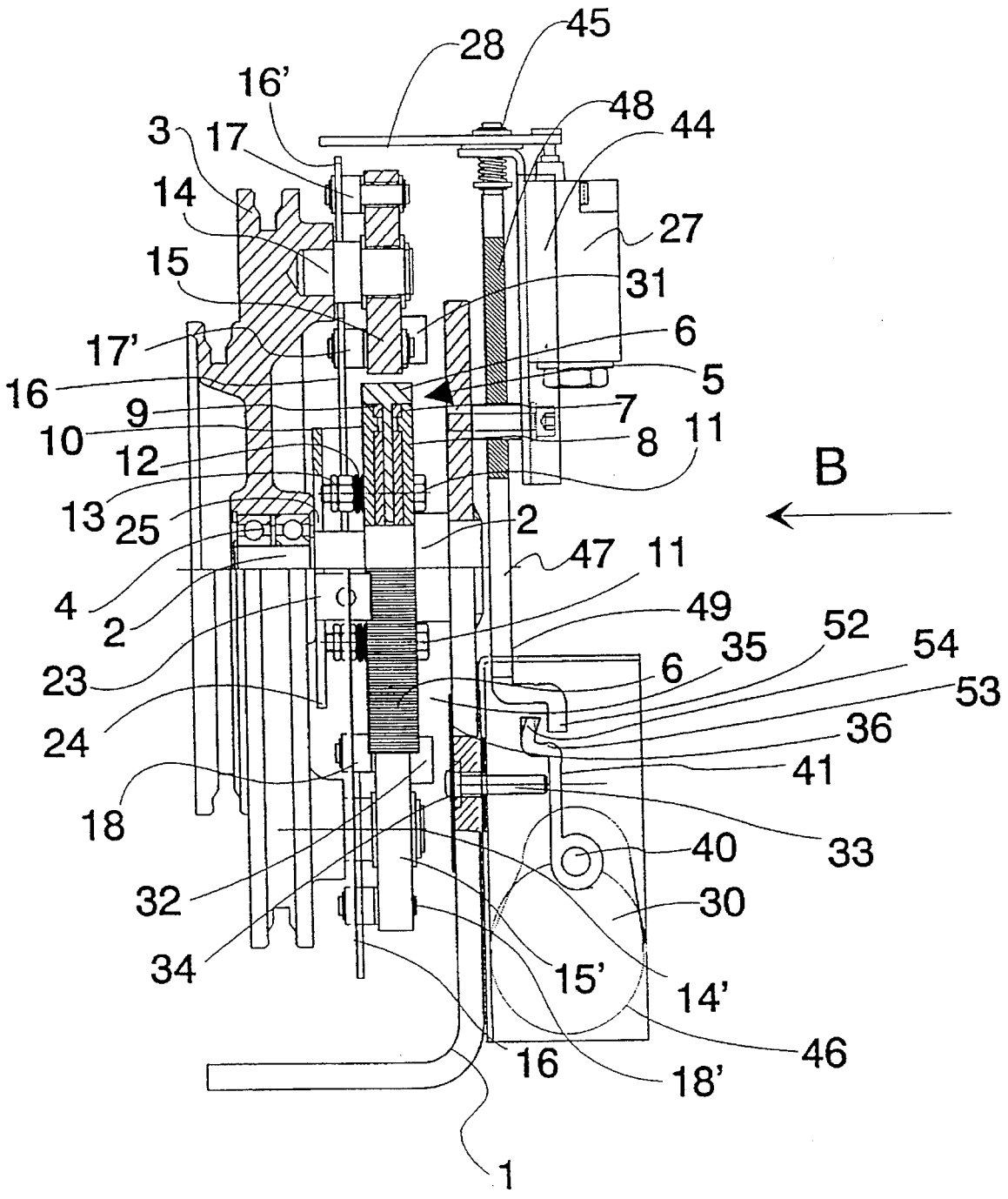
FIG. 1 presents an overspeed governor in which the invention is applied, seen in side view and partially sectioned along line A—A in FIG. 2.
Figure 2:
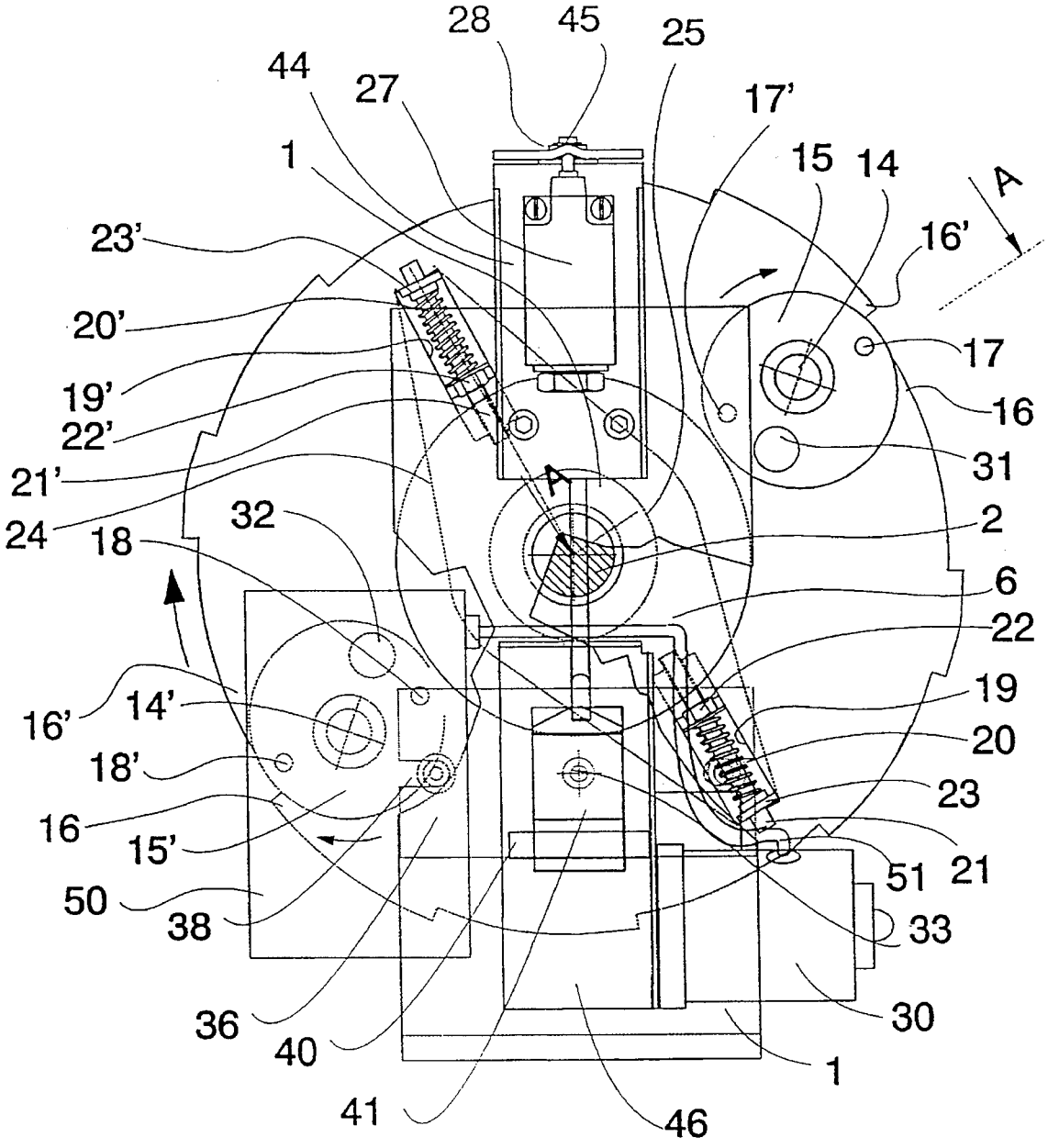
FIG. 2 presents the overspeed governor as seen from direction B in FIG. 1, FIG. 3 and 4 present details of the overspeed governor.

FIGS. 1 and 2 present an example illustrating the main features of an overspeed governor applying the invention. Welded onto a support 1, partially sectioned in FIG. 2, is a shaft 2 which carries a rope pulley 3, which is mounted on the shaft by means of ball bearings 4. Mounted beside the rope pulley on the shaft is a brake 5, which consists of a brake disc 6 rotatable with respect to the shaft 2, a front plate 8 pressed against the brake disc 6 via brake clutches 7 and welded onto the shaft, and a back plate 10 similarly pressed against the brake disc 6 via brake clutches 9. Welded in the front plate 8 are key bolts 14 which go through the front plate 8 and back plate 10 and support disc springs 12 placed against the back plate 10. The disc springs 12 are pretensioned by means of adjusting nuts 13 screwed onto the key bolts 11. The adjusting nuts 13 are used to adjust the braking force applied to the brake disc by the two discs 8 and 10. The overspeed governor presented as an example can be regarded as being mainly a device rotating on the shaft 2 or a device most of whose parts are fitted to rotate about the shaft 2.

The rope pulley 3 supports two knuckle pins 14,14' placed diametrically opposite to each other on the side of the pulley facing towards the brake 5. Rotatably mounted on the knuckle pins 14,14' are two eccentric cams 15,15' placed above the brake disc 6 (i.e. outside the diameter of the brake disc) and acting as coupling elements. The eccentric cams are connected by two curved centrifugal weights 16,16' essentially symmetrical in shape. AS seen from the direction of the shaft 2, the centrifugal weights together form a body resembling a split circular plate with a large opening in the middle for the shaft 2 and other parts. One end of each centrifugal weight 16,16' is turnably mounted on an eccentric bolt 17,17' on the first eccentric cam 15 and the-other end on an eccentric bolt 18,18' on the second eccentric cam 15'. In the mass centre area of each centrifugal weight 16,16' there is an opening 19,19' in which is placed a spring pin 21,21' carrying a counter spring 20,20' formed as a pressure spring. Screwed onto the spring pin 21,21' is an adjusting nut 22,22' protected with a stop plate against thread breakage. One end of the pressure spring 20,20' is retained by the adjusting nut 22,22' while the other end is retained by a lug 23,23' protruding from a spring holder 24 and extending to the opening 19,19'. The two lugs 23,23' are placed at opposite ends of the spring holder 24. The spring holder 24 is held in place by the spring pins 21,21' and the pressure springs 20,20'. The spring holder 24 is provided with a clearance 25 for the shaft 2 in the middle, permitting the spring holder to rotate with the centrifugal weights 16,16' without coming into contact with the shaft 2. The eccentric cams 15,15' are provided with protrusions 31,32 attached to the side facing the support 1, or the protrusions form part of the eccentric cams 15,15'. The protrusions 31,32 are preferably bodies made of rubber or some other elastic material and possibly cylindrical in shape, which are glued onto the eccentric cams. Attached to the support 1 is an electric motor 30, or electromotor fitted to rotate a shaft 40. The electromotor 30 is preferably a geared d.c. electric motor, like the series 0226 (GMRG) motor manufactured by SWF. Fixed to the shaft 40 is a lever 41, which is immovable with respect to the shaft. Fitted on support 1 is a plunger 33 which can pass through a hole 34 provided in the support.

The hole 34 and the plunger 33 as well as the electromotor 30, the shaft 40 and the lever 41 actuated by it are so placed with respect to each other and the shaft 40 and the lever 41 are of such dimensions that, by rotating the electromotor 30, the plunger 33 can be driven in the hole 34 into the space 35 between the support 1 and the rotating parts of the overspeed governor. Preferably the plunger 33 and the hole 34 are so shaped relative to each other that the plunger 33 can only be removed from the hole in the direction towards space 35. However, the plunger 33 is prevented from coming off the hole 34 by a spring plate 36 mounted on the support 1 in a manner permitting some movement. Preferably the spring plate 36 is mounted by means of screws placed in slots 38 at the ends of the spring plate or alternatively in elongaged holes made in the spring plate. The screws are locked in the support in a position which leaves a sufficient clearance between the support 1 and the head of the screw, said clearance exceeding the thickness of the spring plate and thus ensuring that the spring plate remains movable in its mounting in the direction of its plane. The amount of play of the spring plate 36 in the direction of its plane is determined by the placement of the retaining screws on the support and the mutual positions of the slots 38 in the spring plate 36. The amount of play of the spring plate 36 further depends on the thickness of the screws and the size of the slots 38. When the motor 30 is driven in the direction opposite to that used when pushing the plunger 33 into space 35, the spring plate 36 acts as a return spring for the plunger 33. The plunger 33 touches the spring plate 36 at a point essentially at the middle of the flat of the spring plate.

When, by operating the motor 30, the plunger 33 is driven in the hole 34 towards the space 35 between the support 1 and the rotating parts of the overspeed governor, the plunger 33 pushes the spring plate 36 before it. As the spring plate 36 is retained at its ends by the heads of the screws, the pushing force of the plunger 33 causes it to bend in its central portion towards the rotating parts of the overspeed governor. The maximum range of movement of the plunger 33 into space 35 is smaller than that needed to push the spring plate 36 completely apart from its mounting and larger than the distance of the protrusions 31,32 from the spring plate surface facing towards space 35 as measured in the flat position of the spring.

The spring plate 36 is so mounted on the support 1 that the lengthwise direction of the spring plate, in other words the line passing through the midpoints of the securing slots 38, is substantially parallel to the tangent of the path of the protrusion 31,32 attached to the side of the eccentric cam 15,15' when the protrusion 31,32 is in the position directly opposite the plunger 33. The distance of the plunger 33 from the shaft 2 and also the distance of the spring plate 36 from the shaft 2 are fitted to be substantially equal to the distance of the protrusion 31,32 from the shaft 2.

The arrows on the outer circles of the overspeed governor and eccentric cams 15,15' in FIG. 2 indicate the direction of rotation of the overspeed governor corresponding to the direction reaction of elevator travel during gripping and the direction of rotation of the eccentric cams 15,15' corresponding to the acceleration of the elevator.

In an overspeed situation, the overspeed governor functions as follows. Placed on the outer edge of the centrifugal weights 16,16' are tripping cams which, by means of a switching arm, interact with a switch 27 mounted on the support. The switching arm 28 is placed outside the diameter of the orbit of the centrifugal weights 16,16'. When a certain speed of rotation is exceeded, the switch 27 disconnects the operating power as soon as the centrifugal weights 16,16' spread and cause the switching arm 28 to be turned by the tripping cams. Instead of a switch, the device used to disable the operation of the elevator motor could be a disconnector or other suitable device. This rotational speed is lower than the speed which triggers the gripping action. When the set triggering speed is exceeded, the eccentric cams 15,15' are turned by the centrifugal weights 16,16' far enough to cause their eccentric rim to engage the rim of the brake disc 6, whereupon the brake 5 will brake the rope pulley 3 via the eccentric cams 15,15'. Via the rope pulley 3, the rope driving the pulley itself is braked as well, and thus the safety gear of the elevator is triggered.

The switch 27 is attached to the support 1 by means of a mounting 44. The switching arm 28 is turnably mounted on the mounting 44 by means of a bearing part 45. In a simple form of this turnable mounting arrangement, i.e. the bearing part 45, a joint pin attached to the switching arm 28 is passed through a hole in the mounting 44 and the switching arm is held in place by means of a suitable retainer. When the cams of the centrifugal weights 16,16' have turned the switching arm 28 away from its middle position, the supply of driving power to the elevator remains switched off until the switching arm 28 is again returned to the middle position. The middle position is the initial position of the switching arm 28, and when deflected from this position, the switching arm 28 causes the switch 27 to disconnect the operating power. In other words, every time when the supply of operating power to the elevator has been switched off by the switch 27, the switch 27 has to be reset to enable the elevator to be started again. Attached to the switching arm 28 is a crank-like turn bar serving as a resetting part 47. One end of the resetting part 47 is mounted essentially coaxially with the bearing part 45. At its other end 52, the resetting part is passed through a hole 49 in the motor support 46 and has at this other end 52 a crank-like shape, preferably with two bends of essentially equal magnitude, preferably about 90 degrees, turning in opposite directions. Even a single bend of about 45 degrees, would be sufficient for operation, although in practice it would produce axial forces in the bearing part 45. The resetting part 47 is retained radially in place by the bearing part 45 and the hole 49. The resetting part 47 is preferably partially flexible, which is achieved by fitting a flexible coupling element 48 in that portion of the length of the resetting part 47 which goes between the bearing part 45 and the hole 49. The resetting part Ran be provided with a coupling element 48 by forming part of the length of the resetting part 47 from a metal wire plexus or other material which has a degree of flexibility but is still substantially and therefore sufficiently rigid against torsion to enable the switching arm 28 to be turned. The rotational axis of the switching arm 28 is essentially coaxial with the rotational axis of the resetting part 47 attached to it. In respect of technical manufacturing requirements, the flexible coupling element 48 allows a sufficient mismatching in the coaxial fit between the rotational axis of the switching arm 28 and that of the resetting part 47.

The rotational axis of the resetting part 47 is substantially parallel to a plane perpendicular to the shaft 40 which turns the lever 41. The resetting part 47 is preferably so coupled with the switching arm 28 that, when the switching arm 28 is in its middle position, the resetting part 47 with its bends at the lower end 52 lies in a plane perpendicular to the shaft 40. The end 53 of the lever 41 is provided with a slot 54, preferably v-shaped. The mutual positions of the slot 54 and the end 52 of the resetting part are so fitted that, when the switching arm 28 is in its middle position, the end 52 of the resetting part hits the bottom of the V-shaped slot when the lever 41 is turned to a position where the slot 54 meets the end 52 of the resetting part. The shape and dimensions of the end 52 of the resetting means 47 are so selected relative to the dimensions of the slot 54 that, regardless of the position to which the resetting part has been turned by the switching arm 28 as a result of the action of the coupling cams placed on the periphery of the centrifugal weights 16,16' the end 52 of the resetting part always goes into the slot 54 when the lever 41 is turned so that it meets the resetting part 47. The range of the turning movement of the switching arm 28 and the resetting part 47 coupled with it can be limited to a maximum rotational range value as appropriate with regard to ensuring proper operation of the switch 27. The structural parts used to limit the slewing motion are not presented in the figures. When the slot 54 in the lever 41 is pressed against the end 52 of the resetting part, the supporting forces resulting from the V-shape of the slot cause the end 52 to be centered on the bottom of the V-shaped slot, thus returning the switching arm 28 by means of the resetting part 47 to its middle position. Due to the flexible coupling element 48, the resetting part 47 is prevented from getting stuck during the movement. The lever 41, the end 52 of the resetting part and the plunger 33 are so positioned with respect to each other that the plunger 33 lies on one side of the lever 41 while the end 52 lies on the other side of the lever 41. The allowed extreme position of the plunger 33 when pressed towards space 35 and the position of the end 52 of the crank-like resetting part correspond to the extremities of the movement of the lever 41. The movement of the lever 41 is limited to the sector between these two extreme positions.

Figure 3:
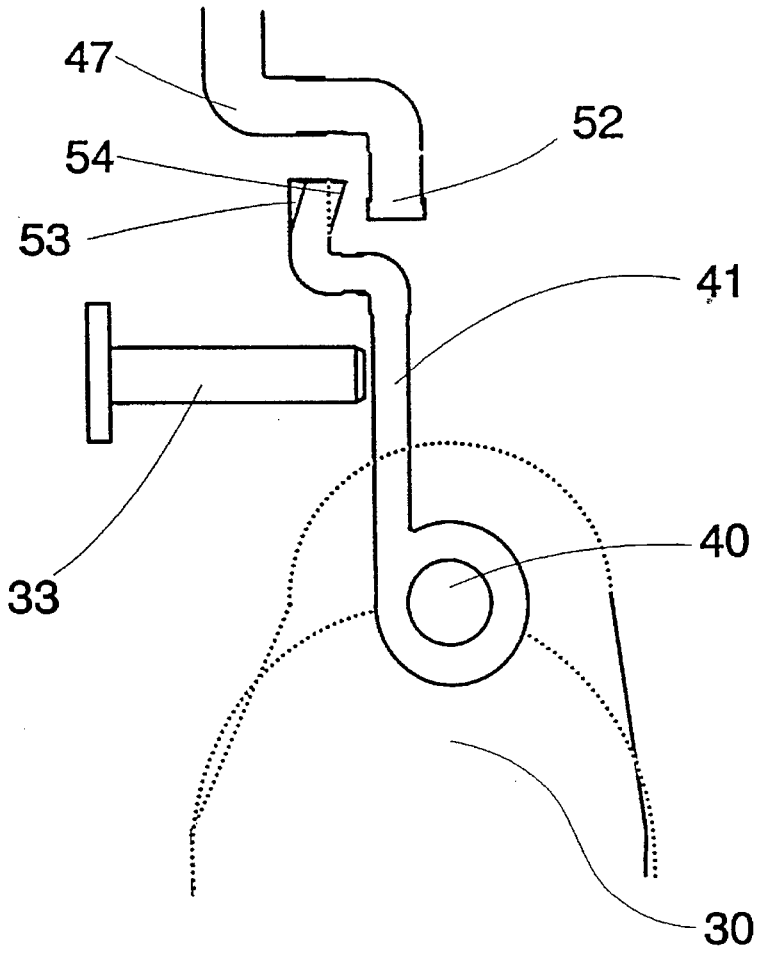

FIG. 3 presents a detail of FIG. 1. In its initial position, the lever 41 is between the resetting part 47 and the plunger 33. The V-shaped slot 54 at the end 53 of the lever 41 opens towards the end 52 of the resetting part.

Figure 4:
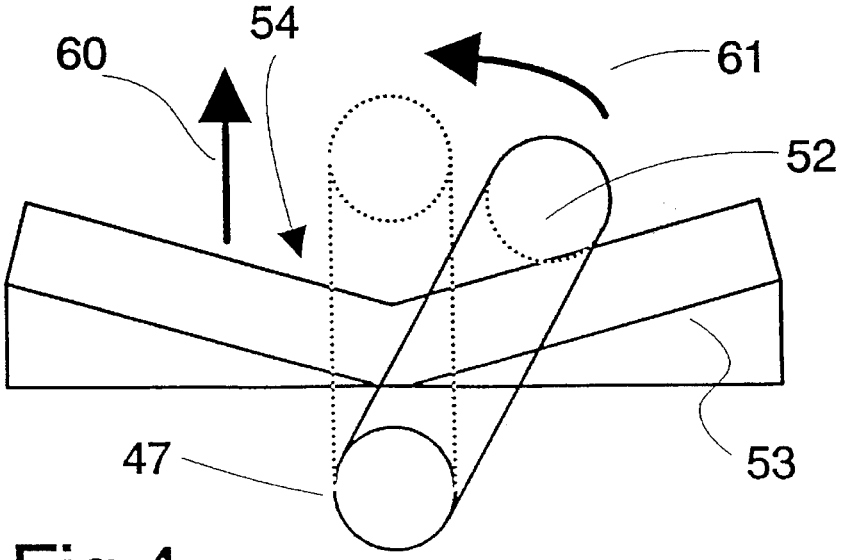

FIG. 4 illustrates the function and mutual positions of the end 52 of the resetting part 47 and the slot at the end 53 of the lever as seen from the direction of the end 53 of the lever. When the switching arm 28 is deflected from its initial position, the end 52 of the resetting part 47 is turned away from its middle position, shown with broken lines in the figure. When the slot 54 at the end of the lever 41 is pressed in the direction indicated by arrow 60 against the end 52 of the resetting part, the supporting forces applied to the resetting part 47 due to the V-shaped form of the slot cause the end 52 of the resetting part to turn to the bottom of the V-slot, in other words, they turn the resetting part 47 and at the same time the switching arm 28 to its middle position. In the situation presented by FIG. 4, this turning motion occurs in the direction indicated by arrow 61.

When the overspeed governor is to be triggered into action by a cause other than the centrifugal force, forced triggering can be implemeted using remote control, in which case the following will occur: Turned by the motor 30, the lever presses the plunger 33, which in turn presses the spring plate 36, causing it to bend towards the gap 35 between the support I and the rotating parts, in the first place the eccentric cams 15,15', of the overspeed governor. As the elevator is moving, as the overspeed governor is rotating, one of the eccentric cams 15,15' will reach the plunger and the protrusion 31,32 on the eccentric cam will hit the spring plate 36, which has been bent towards space 35. Due to its movement, the protrusion 31,32 tends to slide along the curved spring plate 36. In this situation, however, the force, i.e. pressure, applied by the spring plate 36 to the protrusion 31,32 brakes the movement of the protrusion 31,32 due to friction. Since the protrusions 31,32 are attached to the eccentric cams 15 15' which are turnably mounted on the knuckle pins 14,14' and centrifugal weights 16,16', the braking force applied to the protrusion 31,32 causes the eccentric cam 15,15' to turn into a position in which the centrifugal weights 16,16' move into the orbit corresponding to the gripping speed and thus the braking of the protrusion 31,32 indirectly also turns the opposite eccentric cam so that it meets the brake disc. To improve the engagement between the eccentric cams 15,15' and the brake disc 6, their rims can be roughened or jagged or provided with a coating. The area of engagement of the eccentric cams 15,15' can be limited by means of a bolt placed at the edge of the cams 15,15'. As a result of the shift in the orbital position of the centrifugal weights 16,16', at least one of their cams hits the switching arm 28 and turns it away from its middle position.

To return the switching arm 28 to its middle position, to reset the switch 27 into a state that again permits the supply of operating power to the elevator motor, the motor 30 is driven in the direction reverse to that used to press the plunger 33. The slot 54 in the lever 41 is pressed against the end 52 of the resetting part, applying to it a force that, with the movement, centers the end 52 of the resetting part to the centre of the slot. As the resetting part 47 has a crank-like shape and is turnably mounted in the hole 49 and in the bearing part, centering the end 52 to the centre of the slot 54 turns the switching arm 28 to the middle position and thus resets the switch 27.

The motor 30 is operated by means of a motor controller 50. The controller supplies the operating power needed by the motor via a cable 51. At the same time, the motor is given control data determining the direction and speed of its rotation. When the plunger 33 is to be pressed in, a simple control method is to operate the motor 30 for a preset length of time which is positively sufficient to drive the plunger into the desired depth. The plunger is prevented from going too far in by limiting the maximum lever movement to the value required for driving the plunger into the desired depth. Correspondingly, to return the plunger into its rest position, the motor is driven in the reverse direction for a certain length of time, preset for this purpose. The resetting of the switch 27 is also performed by operating the motor 30. The motor is driven by means of the controller 50 in the direction reverse to that used to press the plunger 33. A simple and advantageous control method is to operate the motor 30 for a preset length of time which is positively sufficient to reset the switch 27. After this, the lever 41 is returned to its initial position by driving the motor in the reverse direction for a preset length of time. The initial position of the lever between the plunger 33 and the end 52 of the resetting part 47 is such that the slot 54 does not prevent the resetting part 47 and the switching arm 28 attached to it from being turned by the action of the overspeed governor. The operating commands to the motor controller 50 are issued through the elevator control system or through a separate operator interface.

It is obvious to a person skilled in the art that different embodiments of the invention are not restricted to the examples described above, but that they may instead be varied within the scope of the claims presented below.

I claim:

1. Apparatus in the overspeed governor of an elevator, comprising;

a disabling device for disabling the operation of an elevator motor which moves the elevator; and a controllable electric actuator fitted to reset the disabling device into a state enabling the operation of the elevator motor.

2. Apparatus in the overspeed governor of an elevator, comprising:

a disabling device for disabling the operation of an elevator motor which moves the elevator; and a controllable actuator fitted to reset the disabling device into a state enabling the operation of the elevator motor, wherein the controllable actuator is an electric motor.

3. The apparatus according to claim 1, wherein the disabling device is a switch controlling a supply of electric power to the elevator motor.

4. The apparatus according to claim 1, wherein the actuator is also fitted to return parts transmitting the effect of the overspeed governor to the disabling device to their initial position.

5. Apparatus in the overspeed governor of an elevator, comprising:

a disabling device for disabling the operation of an elevator motor which moves the elevator; and a controllable actuator fitted to reset the disabling device into a state enabling the operation of the elevator motor, wherein the actuator is part of a system used for remote triggering of the overspeed governor.

6. Apparatus in the overspeed governor of an elevator, comprising:

a disabling device for disabling the operation of an elevator motor which moves the elevator;

a controllable actuator fitted to reset the disabling device into a state enabling the operation of the elevator motor;

a mounting;

a bearing part;

a resetting part including a crank-shaped angle bar;

a motor mounting frame with a hole therein; and a lever with a slot at its end; wherein the disabling device is attached to a support by the mounting;

a switching arm is turnably mounted on the mounting by the bearing part;

the crank-shaped angle bar is attached to the switching arm to function as the resetting part;

a first end of the resetting part is mounted substantially coaxially with the bearing part;

a second end of the resetting part is passed through the hole in the motor mounting frame and includes the crank-shaped angle bar attached thereto;

the bearing part and the hole form fulcrum points of a rotational axis of the resetting part;

a rotational axis of the switching arm is substantially coaxial with the rotational axis of the resetting part;

the slot has a V-shaped form;

mutual positions of the slot and the second end of the resetting part are so fitted that, when the switching arm is in a middle position, the second end of the resetting part hits a bottom of the slot when the lever is turned to a position where the slot meets the second end of the resetting part;

the shape and dimensions of the second end of the resetting part are so selected with respect to the dimensions of the slot that, regardless of the position to which the resetting part has been turned by the switching arm as a result of the action of coupling cams placed on a periphery of centrifugal weights, the second end of the resetting part always goes into the slot when the lever is turned so that it meets the resetting part; and a range of the rotational movement of the switching arm and of the resetting part coupled therewith is limited to a maximum rotational range value as appropriate with regard to ensuring proper operation of the disabling device.

7. The apparatus according to claim 1, wherein the controllable actuator is an electric motor.

8. The apparatus according to claim 7, wherein the electric motor is a geared direct current motor.

9. The apparatus according to claim 2, wherein the electric motor is a geared direct current motor.

10. The apparatus according to claim 5, wherein the controllable actuator is an electric motor.

11. The apparatus according to claim 5, wherein the disabling device is a switch controlling a supply of electric power to the elevator motor.

12. The apparatus according to claim 5, wherein the actuator is also fitted to return parts transmitting the effect of the overspeed governor to the disabling device to their initial position.

* * * * *